United States Patent [19]

Pütz et al.

[11] Patent Number: 4,926,634

[45] Date of Patent: May 22, 1990

[54] METHOD AND APPARATUS FOR PRODUCING A HOMOGENEOUS EXHAUST GAS MIXTURE IN AN EXHAUST SYSTEM FOR AN INTERNAL COMBUSTION ENGINE HAVING TWO BANKS OF CYLINDERS

[75] Inventors: Heinrich Pütz, Much; Friedhelm Nowitzki, Engelskirchen; Gunter Damm, Cologne; Hartmut Bathelt, Weinsberg; Günter Krömer, Heilbronn; Henning Hoffmann, Neckarsulm; Reiner Pischke, Bad Friedrichshall, all of Fed. Rep. of Germany

[73] Assignee: Audi AG, Fed. Rep. of Germany

[21] Appl. No.: 353,671

[22] PCT Filed: Dec. 4, 1987

[86] PCT No.: PCT/DE87/00576

§ 371 Date: May 11, 1989

§ 102(e) Date: May 11, 1989

[87] PCT Pub. No.: WO88/04358

PCT Pub. Date: Jun. 16, 1988

[30] Foreign Application Priority Data

Dec. 4, 1986 [DE] Fed. Rep. of Germany ..... 3641376
Nov. 27, 1987 [DE] Fed. Rep. of Germany ..... 3740238

[51] Int. Cl.[5] ..... F01N 3/28

[52] U.S. Cl. ..... 60/274; 60/299; 60/313; 60/276

[58] Field of Search ..... 60/313, 274, 288, 299, 60/276

[56] References Cited

U.S. PATENT DOCUMENTS 3,943,710 3/1976 Lange ..... 60/288
4,305,249 12/1981 Schmid ..... 60/274

FOREIGN PATENT DOCUMENTS 170815 10/1983 Japan ..... 60/313
178820 10/1983 Japan ..... 60/323
1025906 6/1983 U.S.S.R. ..... 60/313

*Primary Examiner*—Douglas Hart
*Attorney, Agent, or Firm*—Kane, Dalsimer, Sullivan, Kurucz, Levy, Eisele and Richard

[57] ABSTRACT

In producing a homogeneous exhaust gas mixture equal portions of the exhaust stream from one cylinder bank and the exhaust stream from a second cylinder bank are combined and then fed to two catalysts. A lambda probe to control the fuel-air ratio is disposed in the path leading to one of the catalysts.

8 Claims, 4 Drawing Sheets

METHOD AND APPARATUS FOR PRODUCING A HOMOGENEOUS EXHAUST GAS MIXTURE IN AN EXHAUST SYSTEM FOR AN INTERNAL COMBUSTION ENGINE HAVING TWO BANKS OF CYLINDERS

The invention relates to a method for producing a homogeneous exhaust gas mixture in an exhaust system in accordance with the introductory part of claim 1 and to apparatus for the practice of the method.

To be able to conform to the emissions standards with regard to the composition of exhaust gases, it is necessary to regulate the composition of the fuel-air mixture such that, insofar as possible, a stoichiometric mixture will be present in all ranges of operation. This is attempted by so-called lambda control, in which the oxygen content in the exhaust is measured with a lambda probe. In internal combustion engines having two banks of cylinders, especially so-called V-engines, it is necessary for reasons of space, among other things, to provide two catalysts, each taking half of the total exhaust stream. To avoid the cost of two lambda probes and the corresponding controls, in a known exhaust system (MTZ 46 (1985) P. 305) a cross connection is provided between the exhaust pipes which runs each from one cylinder bank to a catalyst. The lambda probe is disposed in this cross connection. The cross connection is said to achieve a sufficient mixing of the exhaust streams from the two cylinder banks and to assure correct control by the lambda probe. It has been found in practice, however, that with a cross connection of this kind a homogeneous exhaust mixture cannot be produced, though it is essential for complete detoxification in the two catalysts.

It is the purpose of the invention to create a method which will assure that the exhaust fed to the two catalysts will have a largely identical composition, without the need for any measures which would undesirably increase the back pressure in the exhaust system.

This purpose is accomplished in accordance with the invention by the features specified in the specific part of claim 1.

In the proposal according to the invention, dividing the exhaust stream from each cylinder bank into two parts and bringing a portion of the one exhaust stream together with a portion of the other exhaust stream brings it about that exhaust streams of identical composition and also of identical volume are carried to the two catalysts. The lambda probe can then be disposed in one of the two pipes leading to the catalysts.

Apparatus for the practice of the method are described in the subordinate claims.

Figure 1:
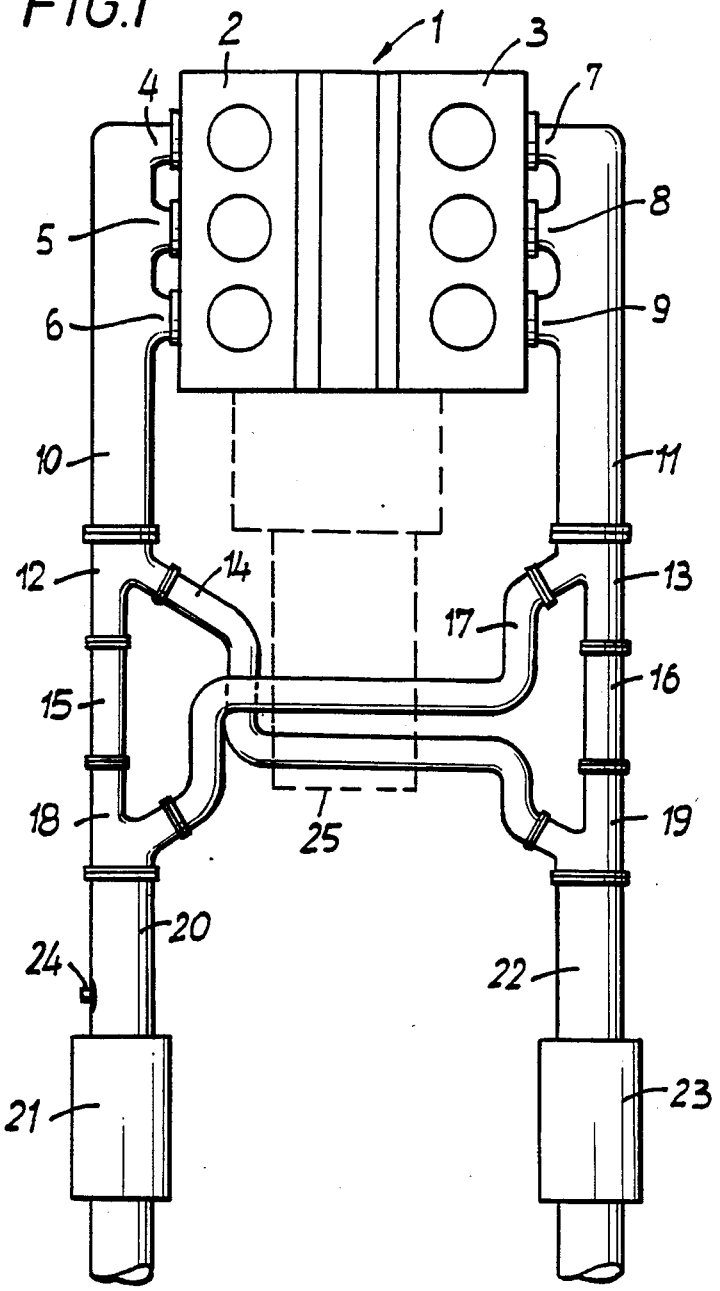
Figure 2:
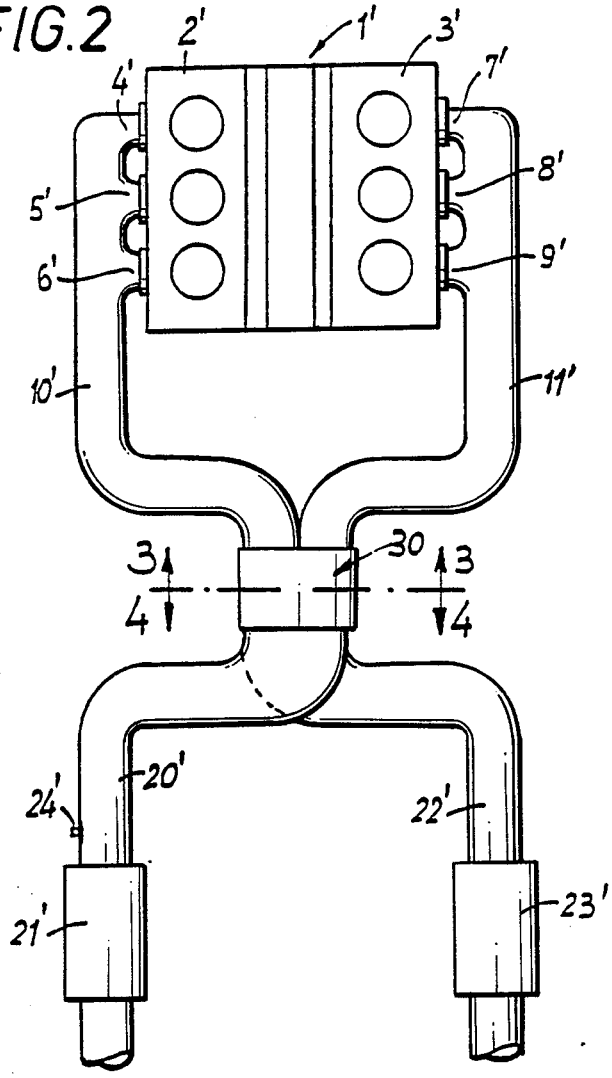
Figure 3:
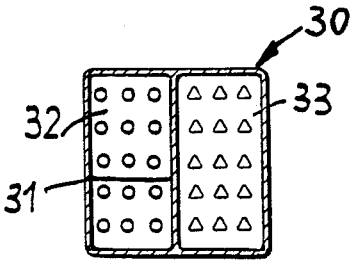
Figure 4:
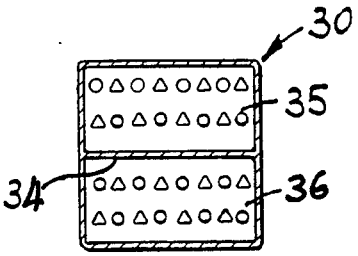
Figure 5:
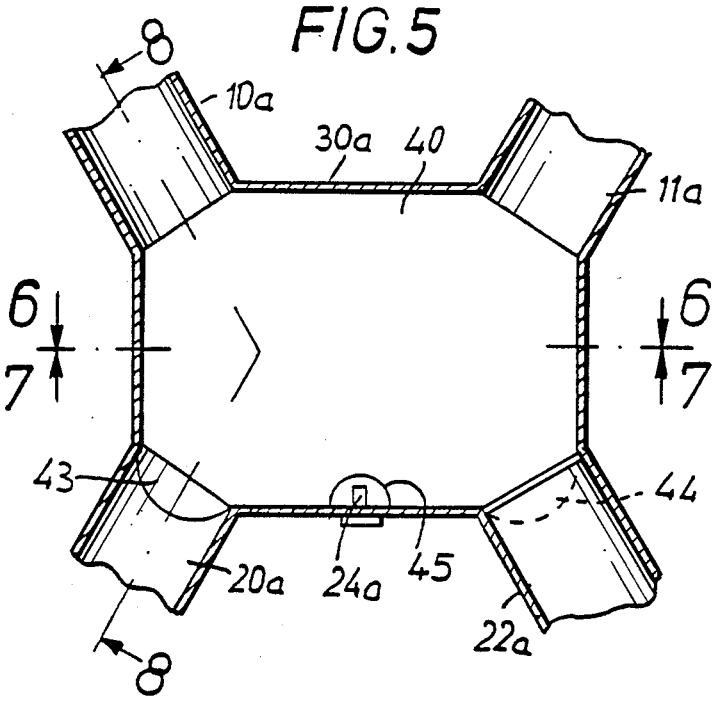
Figure 6:
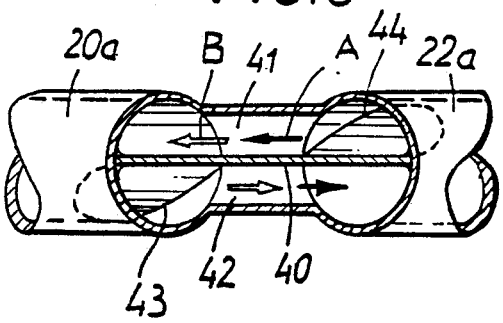
Figure 7:
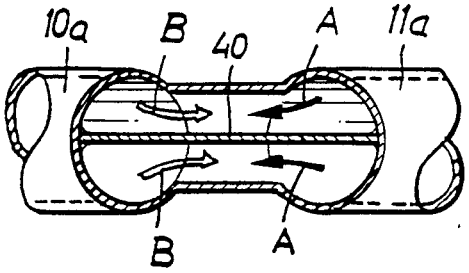
Figure 8:
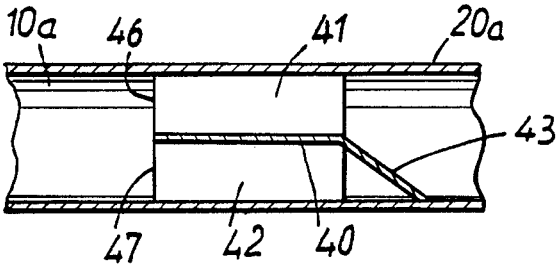
Figure 9:
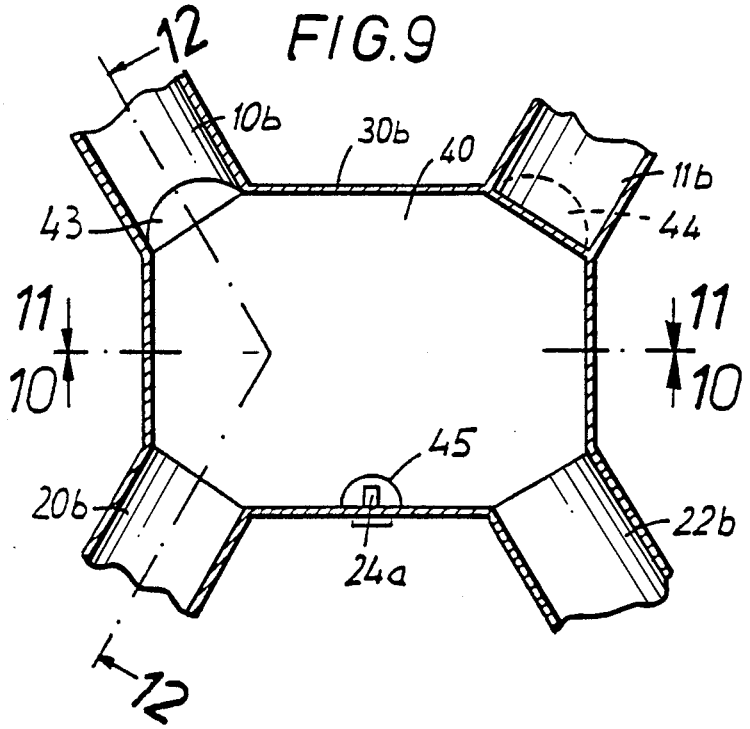
Figure 10:
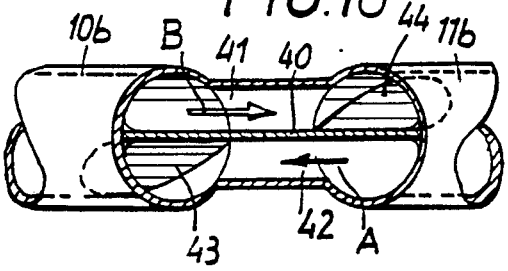
Figure 11:
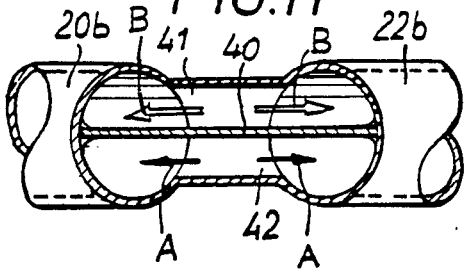
Figure 12:
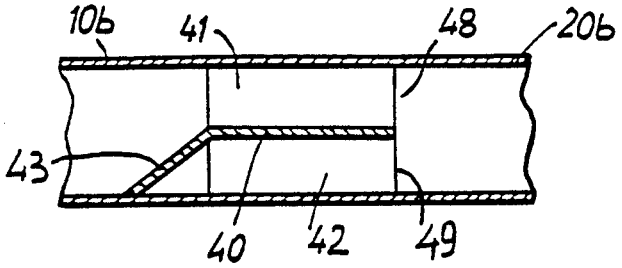

A number of embodiments of the invention are described below in conjunction with the drawings, wherein:

FIG. 1 is a diagrammatic representation of an exhaust system for a V-6 internal combustion engine in a first embodiment, FIG. 2 is a diagrammatic representation of an exhaust system for a V-6 internal combustion engine in a second embodiment, FIG. 3 is a section taken along line 3—3 in FIG. 2, FIG. 4 is a section taken along line 4—4 in FIG. 2, FIG. 5 is a diagrammatic cross section taken through an additional embodiment of a mixing chamber, FIG. 6 is a section taken along line 6—6 in FIG. 5, FIG. 7 is a section taken along line 7—7 in FIG. 5, FIG. 8 is a section taken along line 8—8 in FIG. 5, FIG. 9 is a diagrammatic cross section taken through a third embodiment of the mixing chamber, FIG. 10 is a section taken along line 10—10 in FIG. 9, FIG. 11 is a section taken along line 11—11 in FIG. 9, and FIG. 12 is a section taken along line 12—12 in FIG. 9.

The internal combustion engine 1 represented diagrammatically in FIG. 1 has two cylinder banks 2 and 3 whose exhaust pipes 4, 5 and 6, and 7, 8 and 9, respectively, are combined in exhaust manifolds 10 and 11, respectively. Each manifold 10 and 11 is connected to a divergent wye coupling 12 and 13, respectively, from which two connecting pipes 14, 15, and 16, 17, respectively run. Connecting pipe 15 is connected to a convergent wye coupling 18 into which the branch pipe 17 runs. In the same manner the connecting pipe 16 is connected to a convergent wye coupling 19 into which the connecting pipe 14 runs. An exhaust pipe 20 runs from the convergent wye 15 [18] to a first reactor 21 and a second exhaust pipe 22 runs from the second convergent wye 19 to the second reactor 23.

The divergent wyes 12 and 13 divide the exhaust streams from the two cylinder banks 2 and 3 into substantially equal streams, and the convergent wyes 18 and 19 combine a portion of the exhaust from the one cylinder bank with a portion of the exhaust from the other cylinder bank, so that the composition as well as the volume of the exhaust gases flowing through exhaust pipes 20 and 22 are largely identical. It is thus possible by means of a single lambda probe 24 to detect the oxygen content in the exhaust gas and the composition of the fuel-air mixture fed to the cylinders can be regulated such that a mixture varying only slightly, by lambda=1 is always present, which is necessary for a maximum conversion rate for $NO_x$ and HC in the catalysts 21 and 23.

The two exhaust manifolds 10 and 11 as well as the connecting pipes 15 and 16 run substantially parallel to one another on either side of the internal combustion engine 1. When an internal combustion engine of this kind is installed with the exhaust system represented, in order to interfere as little as possible with the ground clearance of the crossing connecting pipes 14 and 17, since they must run underneath the transmission 25 indicated in broken lines, the crossover point of the two connecting pipes 14 and 17 is situated not in the center between the connecting pipes 15 and 16, but is offset laterally.

In the embodiment in FIGS. 2 to 4, in which equal or similar parts are designated by the same reference number as in FIG. 1, but with a prime, the exhaust manifolds 10′ and 11′ lead into a chamber 30 from which the exhaust pipes 20′ and 22′ lead to the catalysts 21′ and 23′. The chamber 30 has two entrances 32 and 33 which are separated from one another by a first wall 31, and to which the exhaust pipes 20′ and 21′ are connected. The walls 31 and 34 are perpendicular to one another as can be seen in FIGS. 3 and 4. Thus, a mixing of the two exhaust streams fed from the exhaust manifolds 10′ and 11′ takes place because, as in the first embodiment, half of each of the exhaust streams from the exhaust manifolds 10′ and 11′ flows into each exhaust pipe 20′ and 22′, respectively. To represent this mixing, the exhaust gases from the manifold 10′ are indicated by circles and the exhaust gases from manifold 11′ are indicated by triangles. On account of the largely identical composition of the exhaust gases flowing through the exhaust pipes 20' and 22' the control of the fuel-air mixture can again be performed through a single lambda probe 24'.

With the embodiment in FIGS. 5–8, a mixing effect similar to that of the embodiment in FIGS. 2–4 is achieved, but with a less complicated construction. In this embodiment the chamber 30*a*, to which the two exhaust manifolds 10*a* and 11*a* are connected on the one side, and the two exhaust pipes 20*a* and 22*a* are connected on the other, is divided by a separating wall 40 into two subchambers 41 and 42. The desired production of a homogeneous exhaust mixture in both exhaust pipes 20*a* and 22*a* is achieved by the fact that the one exhaust pipe 20*a* is in communication with the one subchamber 41 and the other exhaust pipe 22*a* is in communication only with the other subchamber 42, while the two exhaust manifolds 10*a* and 11*a* are in communication with both subchambers 41 and 42. The dividing of the exhaust streams from the exhaust manifolds 10*a* and 11*a* is achieved in the embodiment represented, by the fact that the dividing wall 40 is provided with tab-like prolongations 42 and 44 which reach into the mouths of the exhaust pipes 22*a* and 22*a* and are bent in opposite directions, so that the exhaust stream from the first subchamber 41 in FIG. 6 is deflected into the exhaust pipe 20*a* and the exhaust stream from the second subchamber 42 is deflected into the exhaust pipe 22*a*. The dividing wall 40 divides the mouth of each exhaust manifold 10*a* and 11*a* into an upper section 46 and a lower section 47, so that each exhaust manifold is in communication both with the first chamber 41 and with the second subchamber 42 (see FIG. 8). In the wall of the chamber 30*a*, a lambda probe 24*a* is provided in the plane of the dividing wall 40, and dividing wall 40 is provided with a cutout 45 in the area of the lambda probe 24*a*, so that the lambda probe 24*a* is reached by the exhaust gas in both chambers 41 and 42. Alternatively, the lambda probe 24*a* can also be disposed in one of the exhaust pipes 20*a* or 22*a*, as in the preceding examples.

The embodiment in FIGS. 9 to 12 differs from the one in FIGS. 5 to 8 basically only in that the two exhaust manifolds 10*b* and 11*b* are in communication each with only one subchamber 41 and 42, respectively, while the two exhaust pipes 20*b* and 22*b* issue from both subchambers 41 and 42. For this purpose the tabs 42 [43] and 44 of the dividing wall 40 are bent in opposite directions and extend into the mouths of the exhaust manifolds 10*b* and 11*b*, while the dividing wall 40 divides the mouths of the exhaust pipes 20*a* and 20*b* into two sections 48 and 49 of which one is in communication with subchamber 41 and the other with subchamber 42. In this manner the same mixing effect is achieved as in the embodiment in FIGS. 5 to 8, which is indicated by the arrows A and B of which arrows B represent the exhaust from the manifold 10*a* and 10*b* and arrows A the exhaust from the manifold 11*a* and 11*b*, respectively. The advantage of the embodiment in FIGS. 9 to 12 over those of FIGS. 5 to 8 lies in the fact that the pulsations of the two exhaust streams A and B affect one another to a lesser extent, so that the total exhaust back pressure is less.

We claim:

1. Method for the production of a homogeneous exhaust gas mixture in an exhaust system with two catalysts (21, 23) for an internal combustion engine (1) with two cylinder banks (2, 3) and with lambda control of the fuel-air ratio by means of a lambda probe (24) disposed in the exhaust, individual exhaust pipes (4, 5, 6) of the first cylinder bank (2) being combined into a first exhaust manifold (10) and individual exhaust pipes (7, 8, 9) of the second cylinder bank (3) being combined into a second exhaust manifold (11), dividing the exhaust stream of each cylinder bank (2, 3) into two substantially equal partial streams and combining a partial stream from each cylinder bank with a partial stream from the other cylinder bank and feeding the combined stream to a catalyst (21 and 23, respectively).

2. Apparatus for the practice of the method of claim 1, comprising:

a first divergent pipe coupling (12) is connected to the first exhaust manifold (10) and a second divergent pipe coupling (13) is connected to the second exhaust manifold, first and second branch pipes (14, 15) run from the first divergent pipe coupling (12) and third and fourth branch pipes (16, 17) run from the second divergent pipe coupling, a first convergent pipe coupling (18) is provided to which the first and third branch pipe (15 and 17) are connected and from which an exhaust pipe (20) leads to a first reactor (21), a second convergent pipe coupling (19) is provided to which the second and the fourth branch pipes (14 and 16, respectively) are connected and from which an exhaust pipe (22) leads to a second reactor (23), and a lambda probe (24) is disposed in one of the exhaust pipes (20, 22) (FIG. 1).

3. Apparatus in accordance with claim 2, characterized in that two (15, 16) of the branch pipes connected to the two divergent pipe couplings (12, 13) run substantially parallel to one another, while the other two branch pipes (14, 17) cross over one another, the crossing point lying asymmetrically between the two parallel branch pipes (15, 16).

4. Apparatus for the practice of the method of claim 1, characterized by a chamber (30) with two entrances (32, 33) separated by a first wall (31), to each of which an exhaust manifold (10' and 11', respectively) is connected, and two outlets (35, 36) separated by a second wall (34), to each of which an exhaust pipe (20' and 22', respectively) leading to a catalyst (21' and 23', respectively) is connected, the two walls (31, 34) being perpendicular to one another and a lambda probe (24) being disposed in one of the exhaust pipes (20', 21') (FIGS. 2 to 4).

5. Apparatus for the practice of the method of claim 1, characterized in that a chamber (30*a* and 30*b*, respectively) is provided, having connections for the two exhaust manifolds (10*a*, 11*a*, and 10*b*, 11*b*, respectively) and for two exhaust pipes (20*a*, 22*a*, and 20*b*, 22*b*, respectively) each containing an exhaust gas catalyst, being divided by a separating wall (40) into a first and a second subchamber (41 and 42, respectively), and that the two subchambers are in communication each with an exhaust pipe (20*a* or 22*a*) and the two manifolds (10*a*, 11*a*), or with one manifold (10*b* or 11*b*) and the two exhaust pipes (20*b*, 22*b*).

6. Apparatus in accordance with claim 5, characterized in that the dividing wall (40) has prolongations (43, 44) bent in opposite directions and reaching into the mouths of the two exhaust pipes (20*a*, 20*b*), which deflect the exhaust stream from the one subchamber (41) into the one exhaust pipe (20*a*) and the exhaust stream from the other subchamber (42) into the other exhaust pipe (22*a*), and that the dividing wall (40) divides the mouths of the exhaust manifolds (10, 11*a*) connected to the chamber (30*a*) into first sections (46 and 47, respectively) in communication with the first subchamber (41) and into second in communication with the second subchamber (42) (FIGS. 5 to 8).

7. Apparatus in accordance with claim 5, characterized in that the dividing wall (40) has prolongations (43, 44) bent in opposite directions and reaching into the mouths of the two exhaust manifolds (10*b*, 11*b*), which deflect the exhaust gas stream from the one manifold (10*b*) to the first subchamber (41) and the exhaust gas stream from the other manifold (11*b*) into the second subchamber (42), and that the dividing wall (40) separates the mouths of the exhaust pipes (20*b*, 22*b*) connected to the chamber (30*b*) into first sections (48, 49) in communication with the first subchamber (41) and into second sections in communication with the second subchamber (42).

8. Apparatus in accordance with any of claims 5 to 7, characterized in that the lambda probe (24*a*) is disposed in the chamber (30*a*) in the plane of the dividing wall (40) and that a cutout (45) is provided in the dividing wall in the area of the probe.

* * * * *